US005190005A

United States Patent [19]

Saito et al.

[11] Patent Number: 5,190,005

[45] Date of Patent: Mar. 2, 1993

[54] ATTACHING STRUCTURE FOR OIL PUMP OF ENGINE

[75] Inventors: Hiroshi Saito; Hideo Fujiwara, both of Shizuoka, Japan

[73] Assignee: Suzuki Motor Corporation, Shizuoka, Japan

[21] Appl. No.: 775,820

[22] Filed: Oct. 11, 1991

[30] Foreign Application Priority Data

Oct. 31, 1990 [JP] Japan ..... 2-294468
Feb. 22, 1991 [JP] Japan ..... 3-50758

[51] Int. Cl.[5] ..... F01M 1/00
[52] U.S. Cl. ..... 123/196 R; 123/195 H
[58] Field of Search ..... 123/196 R, 195 C, 195 H, 123/90.27, 90.31, 192

[56] References Cited

U.S. PATENT DOCUMENTS

| | | | |
|---|---|---|---|
| 4,411,227 | 10/1983 | Feichtinger | 123/196 |
| 4,936,266 | 6/1990 | Imajo | 123/90.31 |
| 5,009,205 | 4/1991 | Abe et al. | 123/195 H |
| 5,014,569 | 5/1991 | Oshima et al. | 123/195 H |
| 5,014,655 | 5/1991 | Ampferer | 123/90.27 |
| 5,024,189 | 6/1991 | Ushio et al. | 123/195 H |
| 5,063,895 | 11/1991 | Ampferer | 123/196 |

FOREIGN PATENT DOCUMENTS

| | | | |
|---|---|---|---|
| 0272677A1 | 6/1988 | European Pat. Off. . | |
| 0406527A1 | 1/1991 | European Pat. Off. . | |
| 57-114116 | 7/1982 | Japan . | |
| 63-174513 | 11/1988 | Japan . | |
| 1-148031 | 10/1989 | Japan . | |
| 0201005 | 8/1990 | Japan | 123/90.31 |
| 0291406 | 12/1990 | Japan | 123/90.31 |

*Primary Examiner*—E. Rollins Cross
*Assistant Examiner*—Erick Solis
*Attorney, Agent, or Firm*—Flynn, Thiel, Boutell & Tanis

[57] ABSTRACT

A V-shaped internal combustion engine in which the driving chain for an oil pump is arranged by using a free space which is formed between a crank journal portion and a sprocket for a timing chain, so that there is no need to extend the crank shaft and to place the oil pump at a position in front of the internal combustion engine. The entire length of the internal combustion engine is reduced and its size is minimized. The oil pump is attached to a skirt portion which is provided at the lower portion of the cylinder block and to a bearing beam which supports the engine crank shaft.

4 Claims, 10 Drawing Sheets

ATTACHING STRUCTURE FOR OIL PUMP OF ENGINE

BACKGROUND OF THE INVENTION

1. Field of the Invention

The invention relates to a mounting and driving structure for an auxiliary apparatus of an internal combustion engine and, more particularly, relates to a mounting and driving structure of an oil pump of a V-shaped internal combustion engine.

2. Description of the Prior Art

Among internal combustion engines for vehicles, there are engines in which the cylinders are arranged in series (in-line engines), engines in which the cylinders are arranged so as to face each other (opposed cylinder engines), engines in which banks of cylinders are arranged in a V-shape, and the like.

V-shaped internal combustion engines in which two banks of cylinders are arranged in a V-shape are constructed in a manner such that first and second cylinder heads are mounted on first and second cylinder banks of a V-shaped cylinder block, and a rotatable crank shaft is provided in the cylinder block so as to extend in the front-to-rear direction of the internal combustion engine. In one type of V-shaped engine, the front edge surface of the first cylinder head projects to a position in front of the front edge surface of the second cylinder head in the axial direction of the crank shaft. First and second rotatable cam shafts are provided for the first and second cylinder heads, first and second cam sprockets are provided in the same plane on corresponding end portions of the first and second cam shafts on the front side of the V-shaped internal combustion engine, a sprocket for a timing chain is provided on a crank shaft end portion of the crank shaft on the front side of the V-shaped internal combustion engine in the same plane as the first and second cam sprockets, and a timing chain is wound around the sprocket for the timing chain and the first and second cam sprockets.

In V-shaped internal combustion engines, an oil pump is provided as an auxiliary apparatus in order to circulate oil from an oil pan to the working parts of the engine that require lubrication. The oil pump is directly attached to the end portion of the crank shaft which projects to a position in front of the internal combustion engine so that the oil pump is directly driven by the crank shaft. Alternatively, the oil pump is driven either (1) by a timing belt or chain which is wound around the pulley or sprocket for the timing belt or chain, which pulley or sprocket is fixed to the end portion of the crank shaft, or (2) by gear mechanism coupled to the crank shaft, or (3) by a chain for the oil pump, which chain is wound around the sprocket for driving the oil pump, which sprocket is provided on the side of the end portion of the crank shaft.

Such driving structures for an auxiliary apparatus of an internal combustion engine have been disclosed in, for instance, Japanese Utility Model Registration No. 63-174513 (1988) and Japanese Utility Model Registration No 1-148031 (1989). According to the driving structure disclosed in Japanese Utility Model Registration No. 63-174513 (1988), an oil pump cover is attached to a chain cover from the side of a chain chamber to thereby form a pump chamber, and an oil pump formed with a saucer-shaped projecting portion, which portion extends to a lower portion of a sprocket which sprocket is attached to a crank shaft and around which a chain is wound, is attached to the oil pump cover. According to the driving structure disclosed in Japanese Utility Model Registration No. 1-148031 (1989), a pulley to drive another auxiliary apparatus is provided on the engine side of a motive power side variable speed pulley in which a centrifugal mechanism is arranged on the side remote from the engine, a driven side variable speed pulley in which a centrifugal mechanism is arranged on the engine side is provided at a position which is away from the drive shaft of the auxiliary apparatus, which apparatus is driven through the variable speed pulley, and an intermediate pulley for propagating and coupling to the drive pulley on the drive shaft is provided on the outer periphery of the centrifugal mechanism of the driven side variable speed pulley.

Hitherto, however, in the structure for attaching the oil pump of the V-shaped internal combustion engine, there is the inconvenience that when the oil pump is directly attached to the crank shaft, the oil pump is arranged on the axis of rotation of the crank shaft, so that the entire length of the internal combustion engine is increased and the mechanical loss is large.

In the structure in which the oil pump is driven by the timing belt, on the other hand, there is the inconvenience that the attaching position of the oil pump is high so that it takes a long time until the oil pump completely discharges the oil upon starting at a low temperature, but also it is disadvantageous because of the chain sound.

In the structure in which the oil pump is driven by the gear mechanism, moreover, there is the inconvenience that gear sounds are generated.

In the structure in which the oil pump is driven by the chain for the oil pump, on the other hand, there is the inconvenience that the sprocket for driving the oil pump is provided on the crank shaft end portion formed by extending the crank shaft in the axial direction, so that the crank shaft is substantially long and the entire length of the internal combustion engine is large.

As another structure for attaching an oil pump to an engine, there is the structure disclosed in Japanese Utility Model Registration No. 57-114116 (1982). In that structure, a stiffener having at least four legs is fixed to a lower surface of a partition wall of a crank casing by bolts, the oil pump is attached to the stiffener, and the oil pump communicates with the crank casing through an oil discharging conduit formed in the stiffener.

In the conventional attaching structure of an oil pump of an engine, when the oil pump is attached to the cylinder block of the engine, various connecting members, such as reinforcing members, stiffeners, and the like, are used thereby assuring rigidity and strength.

There are, however, the inconveniences that (1) because the number of parts is increased when the oil pump is attached to the engine, the costs are increased, that is, it is economically disadvantageous, and (2) the efficiency of the operation for attaching the oil pump is reduced, that is, it is disadvantageous from a practical point of view. There is also the inconvenience that when the oil pump has been attached, the engine size is increased due to various members, and there is a fear that it will be necessary to change the engine design so as to enlarge the oil pan surrounding the oil pump.

SUMMARY OF THE INVENTION

To overcome the above disadvantages, therefore, according to the first embodiment of the invention, there is provided a driving structure of an auxiliary apparatus of an internal combustion engine in which a rotatable crank shaft is provided in a V-shaped cylinder block so as to extend from front to rear in a V-shaped internal combustion engine. The first and second cylinder heads are mounted on first and second cylinder banks of the cylinder block. A front end surface of the first cylinder head projects to a position in front of the front end surface of the second cylinder head in the direction of the axis of rotation of the crank shaft. First and second rotatable cam shafts are provided for the first and second cylinder heads. First and second cam sprockets are provided in the same plane on end portions of the first and second cam shafts on the front side of the V-shaped internal combustion engine. A sprocket for a timing chain is provided on a crank shaft end portion of the crank shaft on the front side of the V-shaped internal combustion engine in the same plane as that of the first and second cam sprockets. A sprocket for driving the oil pump is provided for the crank shaft end portion at a position between a crank journal portion of the crank shaft supported on the cylinder block and the sprocket for the timing chain. A chain for driving the oil pump is wound around the sprocket for driving the oil pump. An oil pump sprocket of the oil pump, around which the chain for the oil pump is wound, is arranged in the same plane as that of the sprocket for driving the oil pump.

According to the invention, the chain for the oil pump is arranged in a dead or free space which is formed between the crank journal portion and the sprocket for the timing chain. There is no need to extend the end portion of the crank shaft and to locate the oil pump in a position in front of the internal combustion engine. Therefore, the entire length of the internal combustion engine is reduced, the engine is made smaller, and the oil pump can be properly driven by the special chain for the oil pump.

It is an object of a second embodiment of the invention to provide a structure for attaching an oil pump to an engine, in which a skirt portion is formed in a lower portion of the cylinder block, a bearing beam to axially support the crank shaft is provided for the cylinder block, and an oil pump is attached to the skirt portion and the bearing beam so that the number of parts required for attaching the oil pump is reduced and it is possible to achieve a smaller size and, also, to improve rigidity and strength.

To accomplish the above object, there is provided a structure for attaching an oil pump to an engine in which the cylinder head is attached to the upper portion of the cylinder block and an oil pan is attached to the lower portion of the cylinder block, and in which a skirt portion is formed in the lower portion of the cylinder block, a bearing beam is provided for the cylinder block to axially support the crank shaft, and the oil pump is attached to the skirt portion and the bearing beam.

By constructing the engine as mentioned above, when the oil pump is attached, it is directly attached to the skirt portion and the bearing beam, the number of parts required for attaching the oil pump is reduced, the structure is made smaller and the rigidity and strength are also improved.

BRIEF DESCRIPTION OF THE DRAWINGS

The invention will be further described with reference to the accompanying drawings, in which.

DESCRIPTION OF PREFERRED EMBODIMENT

Figure 1:
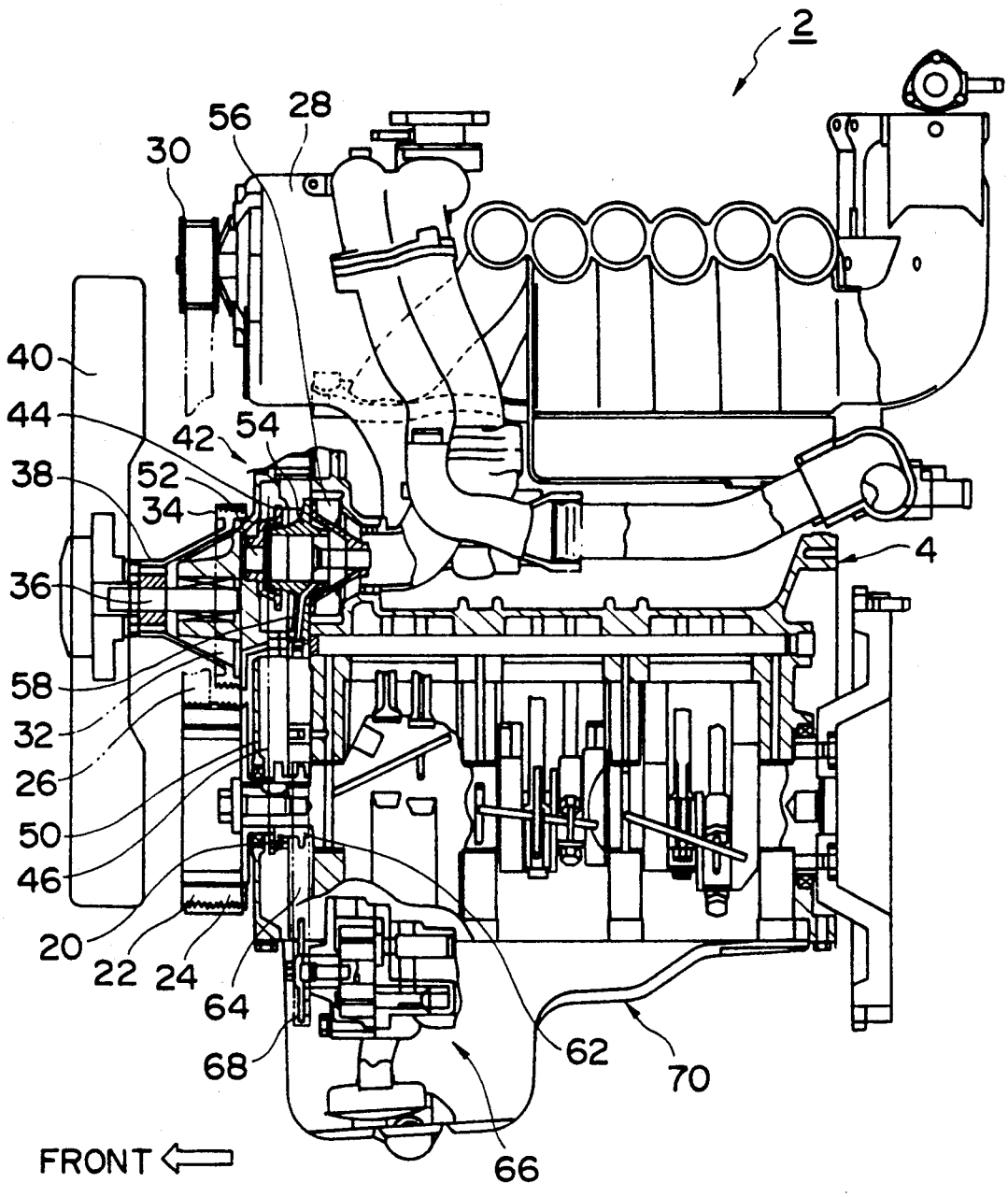
FIG. 1 is a side view, partially in cross-section, of a V-shaped internal combustion engine according to the invention.

Referring to the attached drawings, reference numeral 2 denotes a V-shaped internal combustion engine; denotes a V-shaped cylinder block; 6-1 and 6-2 denote first and second cylinder banks, respectively; and 8-1 and 8-2 denote first and second cylinder heads, respectively. The internal combustion engine 2 is constructed by mounting the first and second cylinder heads 8-1 and 8-2 onto the first and second cylinder banks 6-1 and 6-2 of the V-shaped cylinder block 4.

Figure 2:
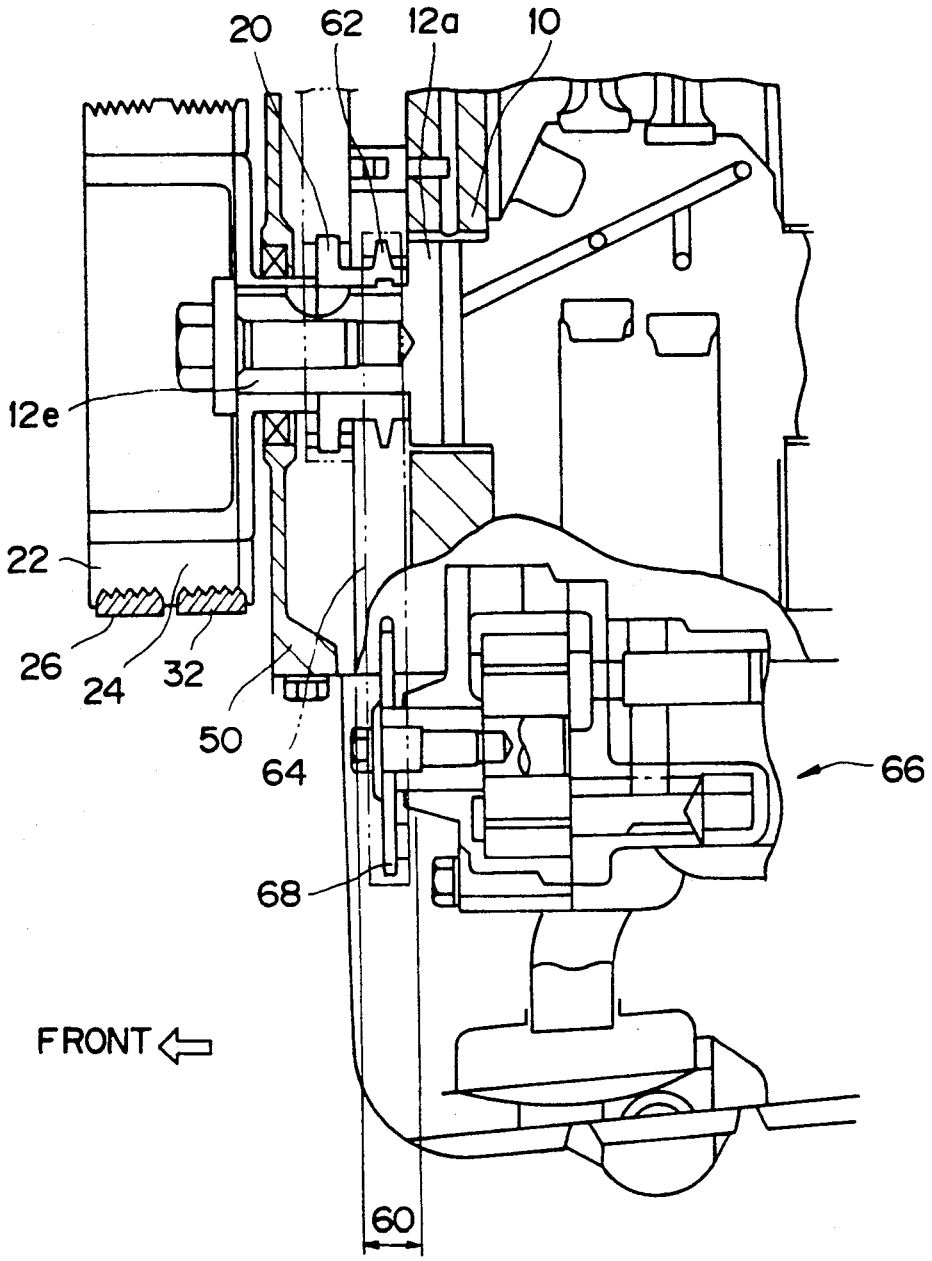
FIG. 2 is a fragment of FIG. 1, on an enlarged scale.
Figure 3:
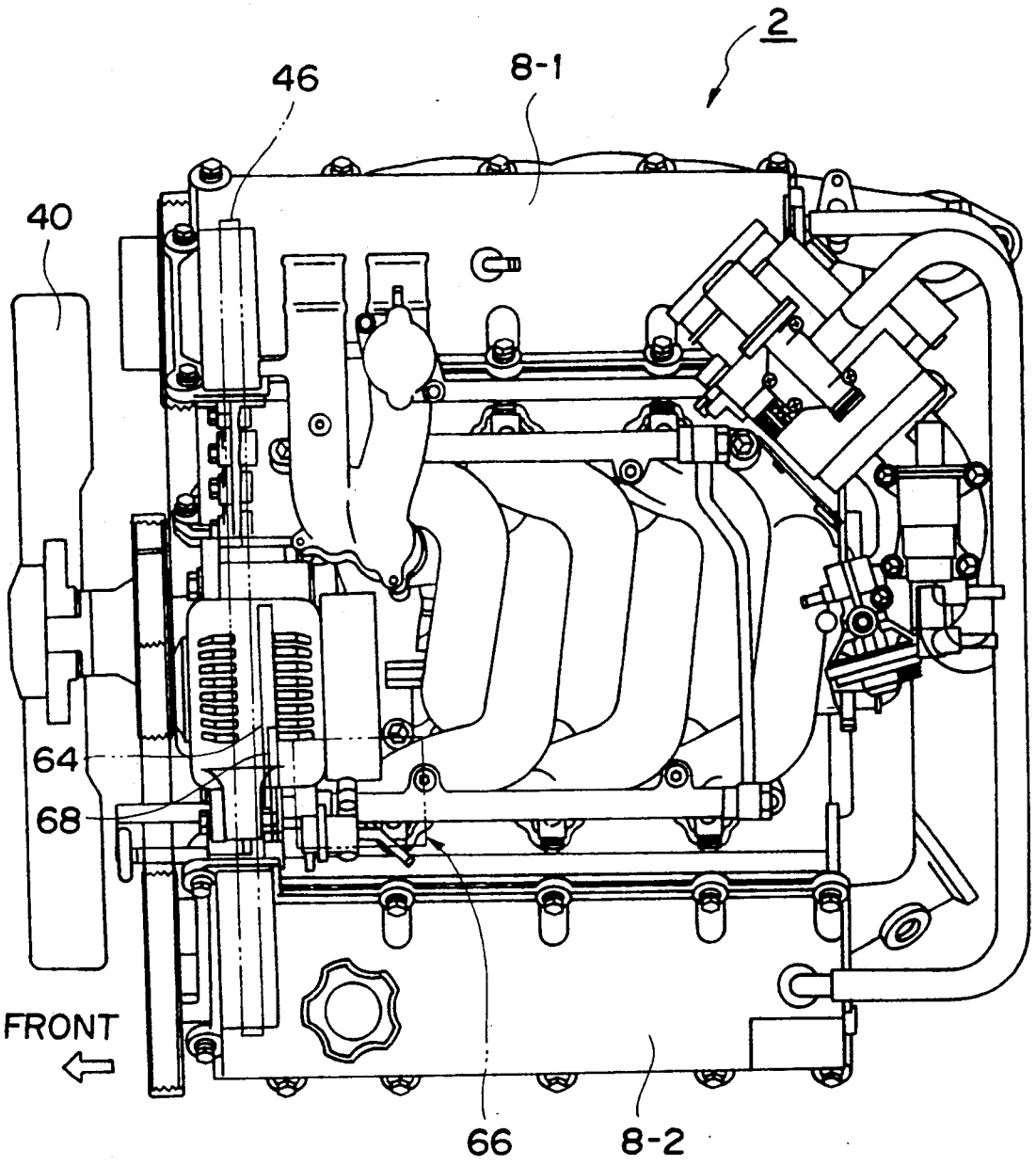
FIG. 3 is a top plan view of the engine of FIG. 1.
Figure 4:
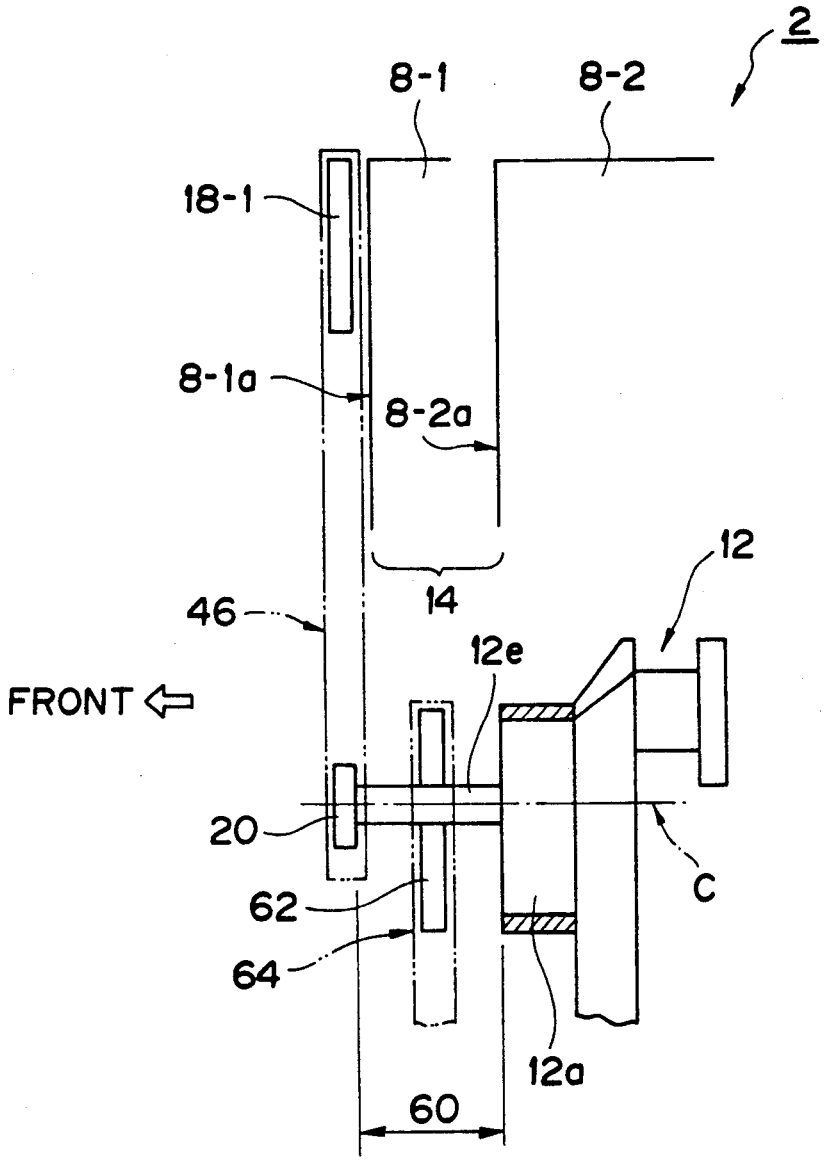
FIG. 4 is a schematic explanatory view illustrating the driving of the auxiliary apparatus.

As shown in FIG. 2, a rotatable crank shaft 12 extends from the front to the rear in the internal combustion engine 2. The crank shaft 12 has a crank journal portion 12*a* which is rotatably mounted in the front wall 10 of the cylinder block 4. As shown in FIG. 4, in the axial direction of the axis of rotation C of the crank shaft 12, the front end surface 8-1*a* of the first cylinder head 8-1 projects forwardly ahead of the front end surface 8-2*a* of the second cylinder head 8-2, so that an axial offset 14 is provided between the first head front end surface 8-1*a* and the second head front end surface 8-2*a*. The first cylinder bank 6-1 functions as a projecting or leading cylinder bank and the seeond cylinder bank 6-2 functions as a backward or trailing bank. The cylinder position of the first cylinder bank 6-1 is located slightly forwardly of the cylinder position of the second cylinder bank 6-2.

Figure 5:
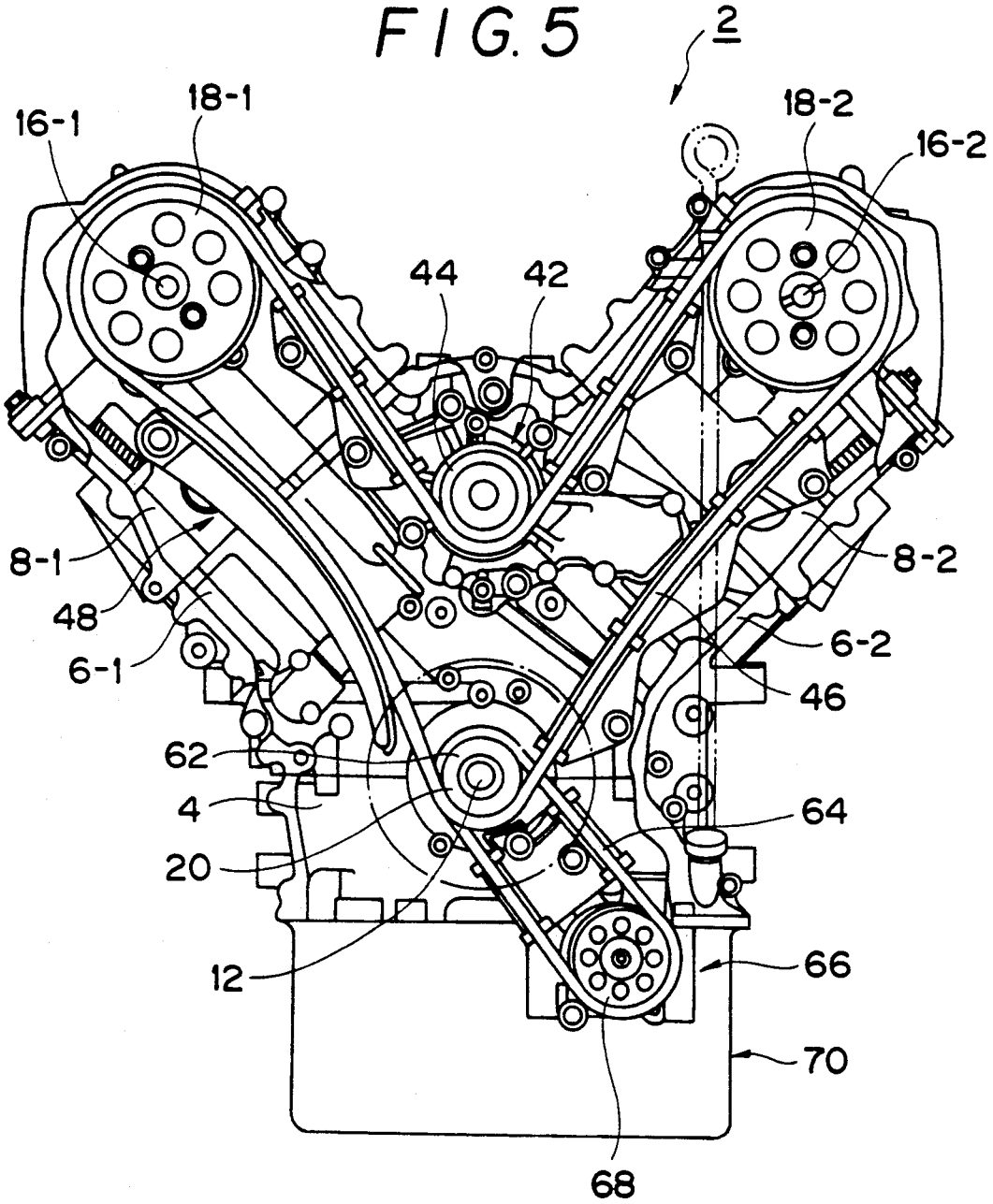
FIG. 5 is a front view of the internal combustion engine of FIG. 1.
Figure 6:
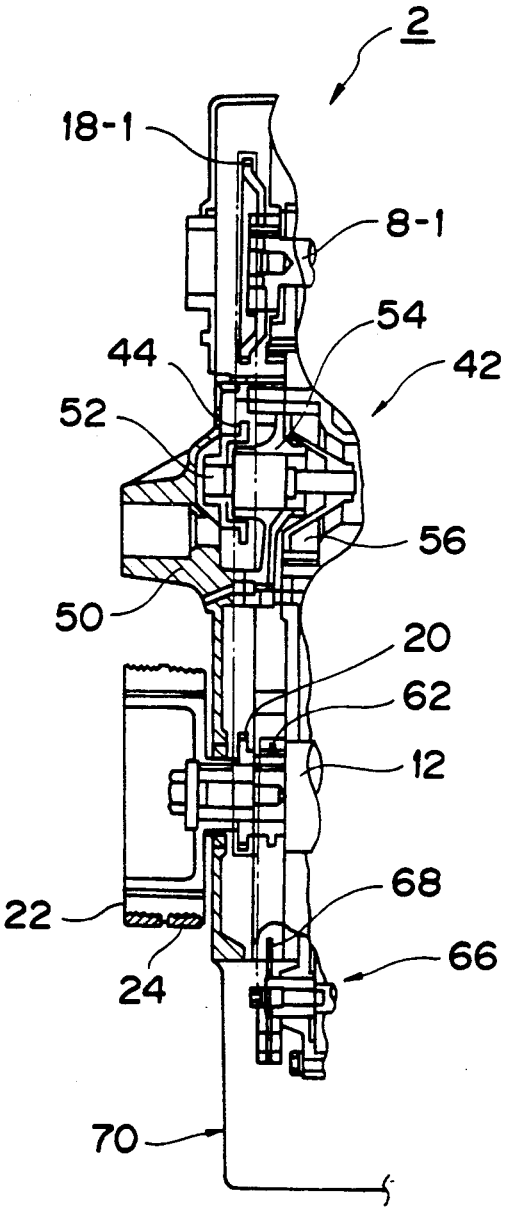
FIG. 6 is a central, vertical, cross-sectional view of the engine of FIG. 5.

As shown in FIG. 5, first and second, rotatable, cam shafts 16-1 and 16-2 are provided on the first and second cylinder heads 8-1 and 8-2.

First and second cam sprockets 18-1 and 18-2 are provided, in the same vertical plane, on the projecting end portions of the first and second cam shafts 16-1 and 16-2 on the front side of the internal combustion engine 2.

A sprocket 20 for a timing chain is fixed to a crank shaft end portion 12*e* and lies in the same vertical plane as the first and second cam sprockets 18-1 and 18-2. The position for attaching the sprocket 20 for the timing chain to the crank shaft end portion 12*e* is limited by the position of the first head front end surface 8-1*a*. First and second, auxiliary-apparatus-driving, crank pulleys 22 and 24 are mounted on the front end of the crank shaft end portion 12*e* for rotation with the crank shaft.

A belt 26 for an alternator is wound around the first, auxiliary-apparatus-driving, crank pulley 22. The belt 26 for the alternator is also wound around an alternator pulley 30 of an alternator 28. The alternator 28 is one of the auxiliary apparatuses that are mounted on the upper portion of the internal combustion engine 2.

A belt 32 for a fan is wound around the second, auxiliary-apparatus-driving, crank pulley 24. The belt 32 is also wound around a fan pulley 34. The fan pulley 34 is fixed to a fan supporting member 38, which in turn is fixed to a fan shaft 36. The shaft 36 is rotatably supported on the front surface of the cylinder block 4. A cooling fan 40 is fixed to the rotatable shaft 36 and the fan supporting member 38. The cooling fan 40 is another one of the auxiliary apparatuses which are associated with the engine.

A water pump 42, another one of the auxiliary apparatuses, is provided on the cylinder block 4 and is located above the crank shaft 12. A water pump sprocket 44 of the water pump 42 is located in the same vertical plane as the first end second cam sprockets 18-1 and 18-2 and the sprocket 20 for the timing chain.

As shown in FIG. 5, a single timing chain 46 is wound around the first cam sprocket 18-1 which is fixed to the first cam shaft 16-1, the sprocket 44 of the water pump 42, and the second cam sprocket 18-2 which is fixed to the second cam shaft 16-2.

The tension of the timing chain 46 is maintained by a tensioner 48.

The sprocket 20 for the timing chain 46, the first and second cam sprockets 18-1 and 18-2, and the water pump sprocket 44 are covered by a chain cover 50.

The water pump sprocket 44 is fixed to a water pump shaft 52. The water pump shaft 52 is supported by a pump main body 54 which is attached to the cylinder block 4. An impeller 56 is fixed to the water pump shaft 52 for rotation, thereby circulating cooling water. A drain passage 58 is formed in the pump main body 54.

In the internal combustion engine 2, as shown in FIG. 2, the first cylinder bank 6-1 functions as a projecting or axially leading cylinder bank and the second cylinder bank 6-2 functions as a backward or axially trailing cylinder bank, so that a free space 60 is provided between the crank journal portion 12*a* and the sprocket 20 for the timing chain.

An auxiliary sprocket 62 for driving an oil pump 66 is fixed to the crank shaft end portion 12*e* between the crank journal portion 12*a* and the sprocket 20 for the timing chain. A chain 64 for driving the oil pump is wound around the auxiliary sprocket 62. An oil pump sprocket 68 of the oil pump 66 is arranged in the same vertical plane as the chain 64 for the oil pump and the sprocket 62. The chain 64 for driving the oil pump is wound around the oil pump sprocket 68.

The oil pump 66 is attached to the cylinder block 4 so as to be located on the side of the second cylinder bank 6-2, namely, the backward or rearward cylinder bank, in the upper portion in the oil pan 70, for supplying the oil in the oil pan 70 to each section of the internal combustion engine 2 that requires lubrication.

Referring to the mounting of the oil pump 66, an outer peripheral portion of the cylinder block 4 is extended so as to connect the oil pan 70. A skirt portion 110 is formed in the outer peripheral portion of the lower surface of the cylinder block 4.

A bearing beam 114 for axially supporting the crank shaft 12 and for improving the rigidity and strength of the cylinder block 4 is attached to the cylinder block 4.

The oil pump 66 is attached to the skirt portion 110 and the bearing beam 114.

Figure 8:
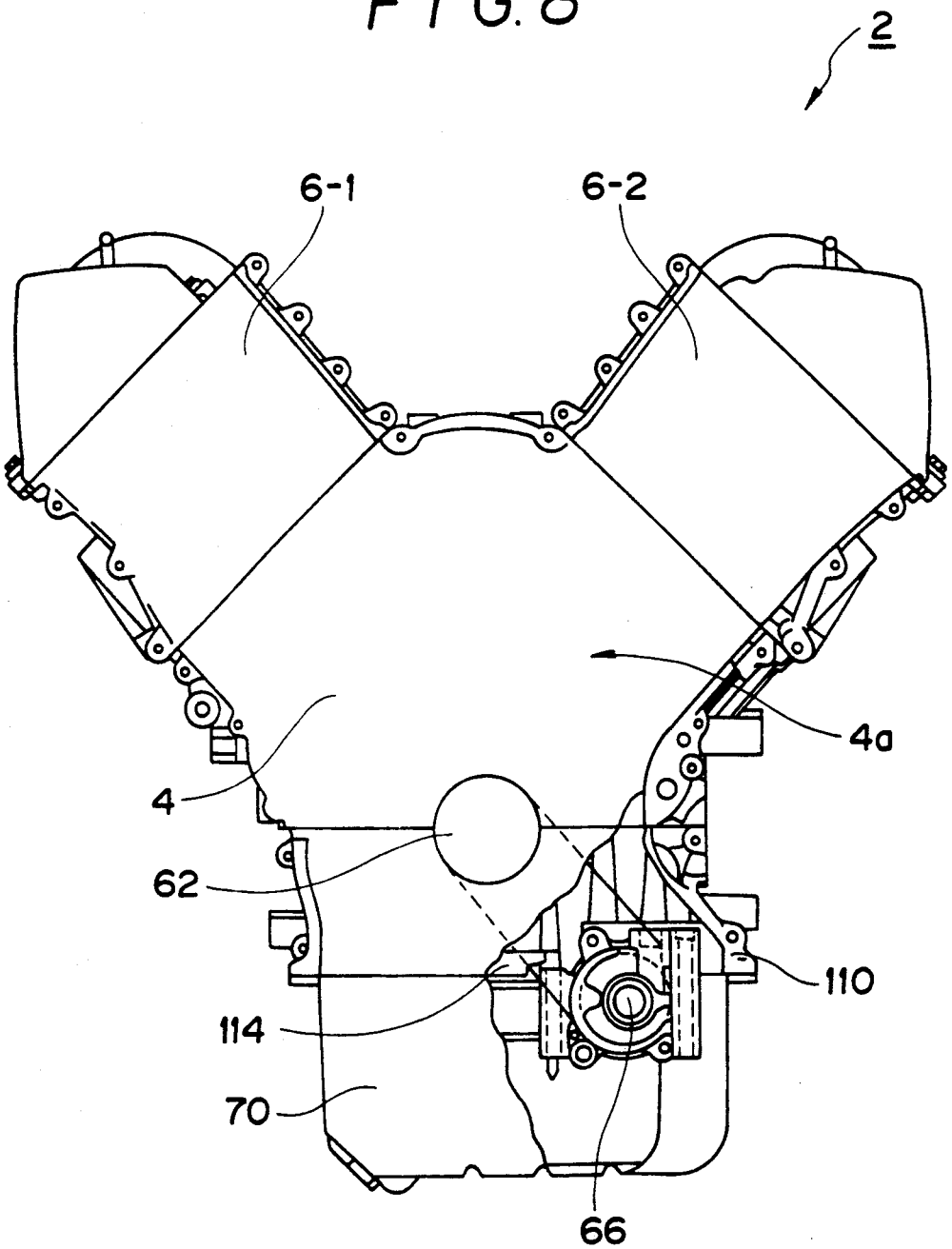
FIG. 8 is a partially broken-away, front view of the engine, showing the attachment of the oil pump.
Figure 10:
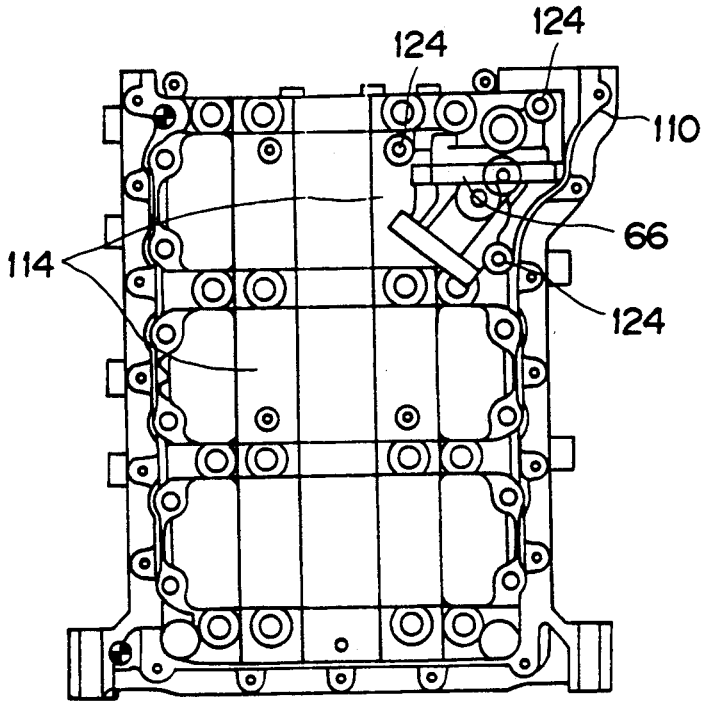
FIG. 10 is a bottom view showing the oil pump mounted on the cylinder block.

In more detail, as shown in FIGS. 8 and 10, the oil pump 66 is attached below the front surface 4*a* of the cylinder block 4.

Figure 9:
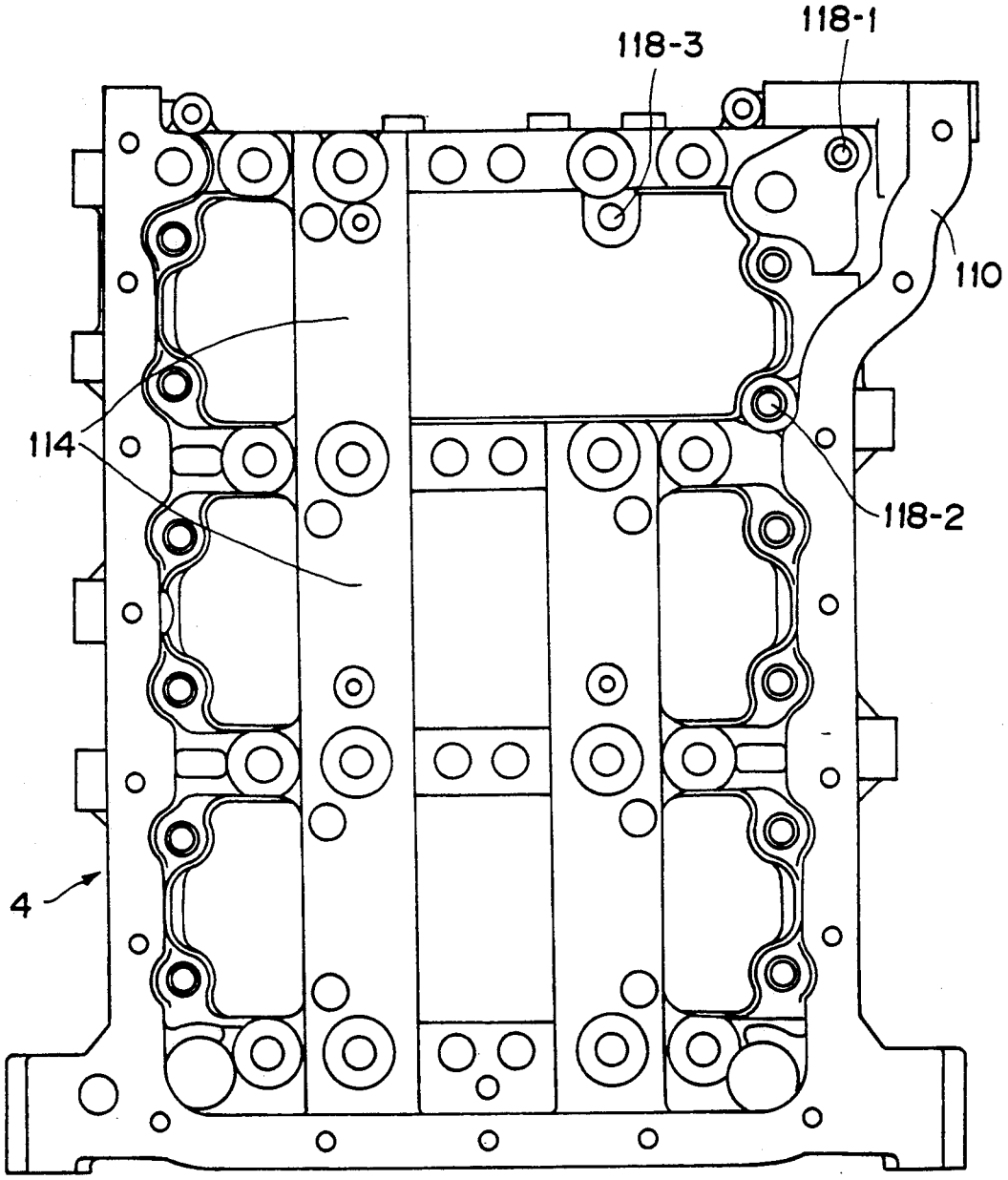
FIG. 9 is a bottom view of the cylinder block.

That is, as shown in FIG. 9, two first and second attaching hole portions 118-1 and 118-2 are formed in the skirt portion 110. A third attaching hole portion 118-3 is formed in the bearing beam 114 on the inner side relative to the skirt portion 110.

Figure 7:
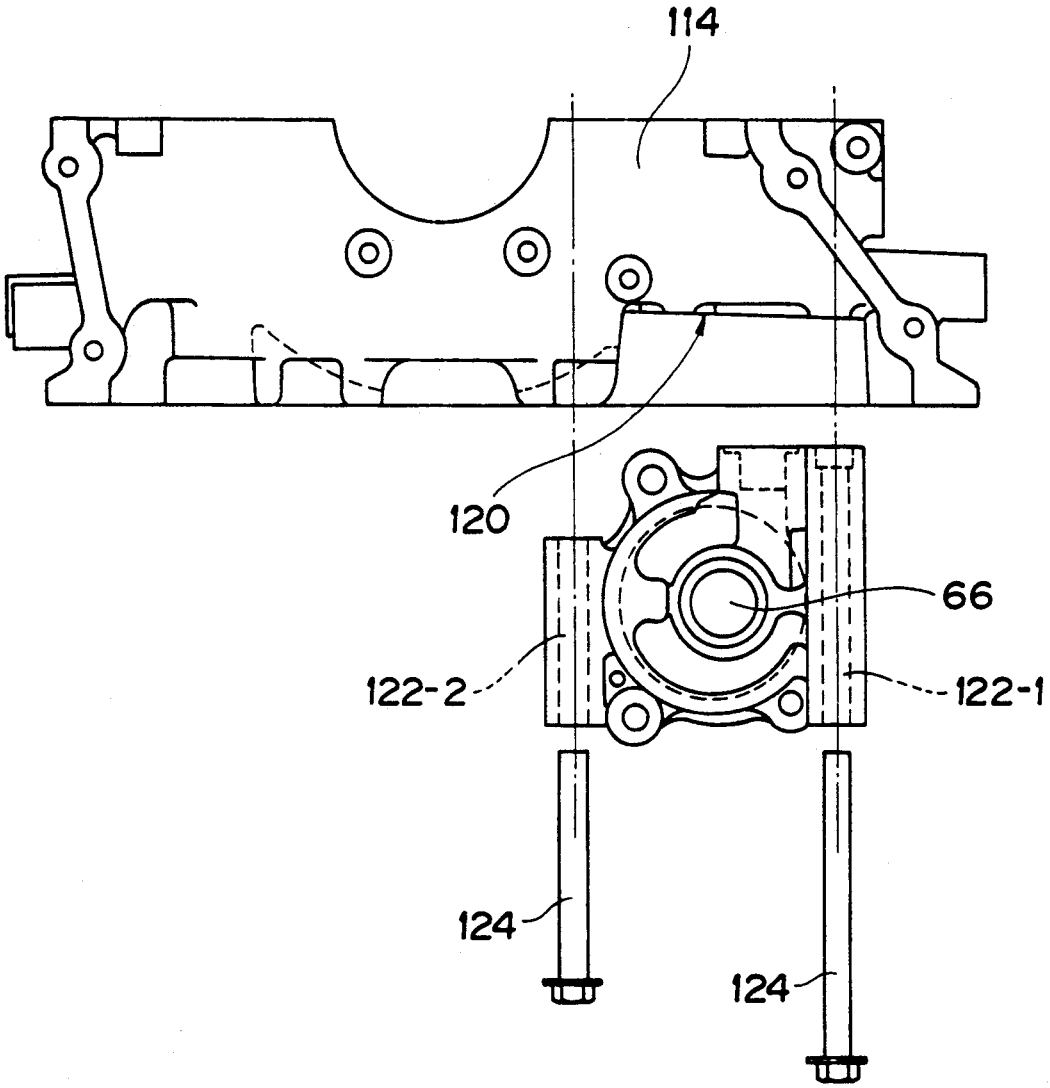
FIG. 7 is a schematic illustration indicating how the oil pump is attached to the bearing beam.

As shown in FIG. 7, a concave portion 120 is formed in the lower surface of the bearing beam 114. A part of the upper portion of the oil pump 66, for instance, almost ⅓ of the entire height of the oil pump 66 is received into the concave portion 120.

Figure 11:
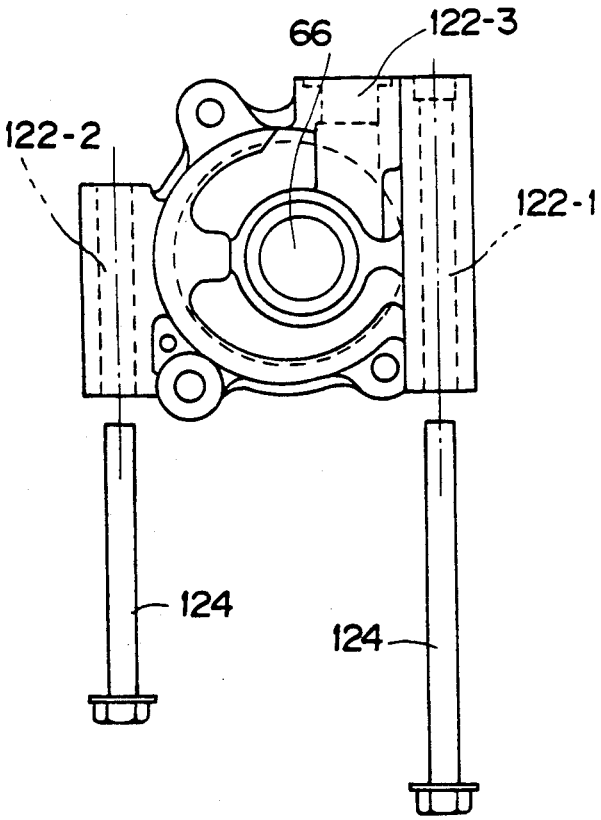
FIG. 11 is a front view of the oil pump.
Figure 12:
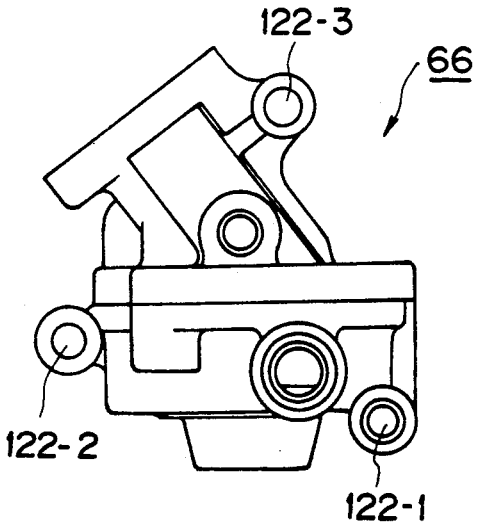
FIG. 12 is a top view of the oil pump.

Further, as shown in FIGS. 7, 11, and 12, the three, through holes 122-1, 122-2 and 122-3 are formed in the oil pump 66. Attaching bolts 124 for directly attaching the oil pump 66 to the skirt portion 110 and the bearing beam 114 through the first to third through holes 122-1, 122-2, and 122-3 are provided for the oil pump 66.

When the oil pump 66 is to be attached to the cylinder block 4, a part of the upper portion of the oil pump 66 is brought into engagement with the concave portion 120 on the lower surface of the bearing beam 114 and the oil pump 66 is directly attached to the skirt portion 110 and the bearing beam 114 by the attaching bolts 124 which extend through the three, first to third, through holes 122-1, 122-2, and 122-3 formed in the oil pump 66.

That is, the attaching bolts 124 are respectively threadably inserted into the two first and second attaching hole portions 118-1 and 118-2 formed in the skirt portion 110 and into the third attaching hole portion 118-3 formed in the bearing beam 114, thereby directly attaching the oil pump 66 to the skirt portion 110 and the bearing beam 114. Because of this, the number of parts that are needed to attach the oil pump 66 can be reduced, and the engine can be manufactured more easily and at a lower cost. The assembly efficiency for attaching the oil pump 66 can be improved. By reducing the number of parts, it is possible to reduce the size when the oil pump 66 has been attached, and there is no need to change the design so as to enlarge the oil pan 70 surrounding the oil pump 66. A part of the upper portion of the oil pump 66 is received into the concave portion 120 of the lower surface of the bearing beam 114. The oil pump 66 is directly attached to the skirt portion 110 and the bearing beam 114 by the attaching bolts 124. Thus, the rigidity and strength of the cylinder block 4 can be improved without using additional parts. As described in detail above, according to the invention, the skirt portion 110 is formed in the lower portion of the cylinder block 4, the bearing beam 114 to axially support the crank shaft is provided for the cylinder block, and the oil pump 66 is attached to the skirt portion 110 and the bearing beam 114. Therefore, the number of parts needed when executing the operations to attach the oil pump can be reduced, it is possible to easily manufacture the engine and the cost can be reduced. The working efficiency of the procedure for attaching the oil pump can be improved. Since the number of parts can be reduced, it is possible to reduce the size when the oil pump has been attached. There is no need to change the design so as to enlarge the oil pan surrounding the oil pump. Further, since the oil pump is attached to the skirt portion and the bearing beam, the rigidity and strength of the cylinder block can be also improved without using additional parts.

The operation of the engine will now be described briefly.

When the first and second auxiliary apparatus driving pulleys 22 and 24 are rotated, caused by rotation of the crank shaft 12 of the internal combustion engine 2, the alternator 28 is driven by the belt 26 and the cooling fan 40 is also rotated by the belt 32. The first and second cam shafts 16-1 and 16-2 are rotated by the timing chain 46 and the water pump 42 is also driven. The oil pump 66 is driven by the chain 64.

The position of the timing chain 46 is limited because the first cylinder bank 6-1 is offset forwardly or projecting forwardly relative to the second cylinder bank 6-2. Thus, the chain 64 for the oil pump can be arranged in the free or dead space 60 formed between the sprocket 20 for the timing chain and the crank journal portion 12*a*. Therefore, there is no need to extend the crank shaft end portion 12*e* to a position in front of the internal combustion engine 2 in order to arrange the chain 64 for the oil pump. The entire length of the internal combustion engine 2 can be reduced and its weight can be decreased. The oil pump 66 can be properly driven by driving the oil pump 66 by the special chain 64 for the oil pump.

As will be understood from the above detailed description, according to the invention, in the V-shaped internal combustion engine in which the front end surface of the first cylinder head projects forwardly relative to the front end surface of the second cylinder heads in the axial direction of the crank shaft, the auxiliary sprocket for driving the oil pump is provided on the crank shaft end portion at a position between the crank journal portion of the crank shaft supported on the cylinder block and the sprocket for the timing chain. The chain for driving the oil pump is wound around the auxiliary sprocket for driving the oil pump. The oil pump sprocket (driven sprocket) is arranged in the same vertical plane as the auxiliary sprocket to drive the oil pump. Therefore, the chain for the oil pump can be arranged by using the free space provided between the crank journal portion and the sprocket for the timing chain. There is no need to extend the end portion of the crank shaft and to project the oil pump to a position in front of the internal combustion engine. Thus, the entire length of the internal combustion engine can be reduced and the size can be made smaller. Moreover, the oil pump can be properly driven by the special chain for the oil pump.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A V-shaped internal combustion engine, comprising a V-shaped cylinder block having a rotatable crank shaft therein, said cylinder block having first and second cylinder banks, first and second cylinder heads mounted on said first and second cylinder banks, said first and second cylinder heads having first and second front end surfaces, respectively, said first front end surface of said first cylinder head being offset axially forwardly relative to said second front end surface of said second cylinder head in the direction of the axis of rotation of said crank shaft, first and second rotatable cam shafts mounted on said first and second cylinder heads, respectively, first and second cam sprockets mounted on first and second cam shaft end portions of said first and second cam shafts on the front side of the V-shaped internal combustion engine, said first and second cam sprockets lying in the same vertical plane, a single timing chain, a single timing chain drive sprocket for driving said timing chain and mounted on an end portion of said crank shaft on the front side of the V-shaped internal combustion engine and in the same vertical plane as said first and second cam sprockets, an oil pump having an oil pump drive sprocket, means mounting said oil pump below and laterally offset from said crank shaft, said oil pump being located rearwardly of said second front end surface of said second cylinder head, an auxiliary, drive sprocket mounted on said crank shaft end portion at a position forwardly of said second front end surface of said second cylinder head and between a crank journal portion of said crank shaft supported by said cylinder block and said timing chain drive sprocket, a chain wound around said auxiliary sprocket and said oil pump drive sprocket for driving said oil pump when said auxiliary drive sprocket is rotated, said oil pump drive sprocket being arranged in the same vertical plane as said auxiliary drive sprocket.

2. A V-shaped internal combustion engine as claimed in claim 1, in which said engine has an oil pan attached to a lower portion of said cylinder block, said cylinder block has a skirt portion in the lower portion thereof, a bearing beam for axially supporting said crank shaft, said bearing beam being provided at the lower portion of said cylinder block and above said oil pan, said oil pump being attached to said skirt portion and said bearing beam.

3. An internal combustion engine comprising a cylinder block, a crank shaft, a cylinder head attached to an upper portion of said cylinder block, an oil pan attached to a lower portion of said cylinder block, an oil pump for pumping engine oil in said oil pan and for supplying the engine oil to sections of the engine that require lubrication, a skirt portion in the lower portion of said cylinder block, support means in said skirt portion for supporting said crank shaft for rotation, said support means including a bearing beam provided at the lower portion of said cylinder block and above said oil pan, said oil pump being attached to the underside of said skirt portion and said bearing beam, said oil pump being disposed laterally offset from said crank shaft and extending downwardly below the lower side of said skirt portion and into said oil pan.

4. An internal combustion engine as claimed in claim 3 in which said bearing beam has a concavity in the lower side thereof, said concavity being laterally offset from said crank shaft, said oil pump including a portion extending upwardly into said concavity, said bearing beam and said skirt portion and said pump having matching bolt holes and bolts in said bolt holes for securing said pump to said bearing beam and said skirt portion.

* * * * *